United States Patent [19]

Schuettenberg

[11] Patent Number: 4,478,604

[45] Date of Patent: Oct. 23, 1984

[54] GASOLINE COMPOSITIONS CONTAINING BRANCHED CHAIN AMINES OR DERIVATIVES THEREOF

[75] Inventor: Alexander D. Schuettenberg, Bartlesville, Okla.

[73] Assignee: Phillips Petroleum Company, Bartlesville, Okla.

[21] Appl. No.: 364,361

[22] Filed: Apr. 1, 1982

[51] Int. Cl.[3] ..... C10L 1/22

[52] U.S. Cl. ..... 44/63; 44/70; 44/71; 44/72; 252/392

[58] Field of Search ..... 44/70, 71, 63; 252/392

[56] References Cited

U.S. PATENT DOCUMENTS

| | | | |
|---|---|---|---|
| 1,692,784 | 11/1928 | Orelup et al. | 44/71 |
| 2,490,744 | 12/1949 | Trigg et al. | 252/392 |
| 2,568,472 | 9/1951 | Trautman | 252/33.6 |
| 2,604,451 | 7/1952 | Rocchini | 252/392 |
| 2,629,649 | 2/1953 | Wachter et al. | 252/392 |
| 2,739,871 | 3/1956 | Senkus | 252/392 |
| 2,750,339 | 6/1956 | Steinhauff | 252/392 |
| 2,758,916 | 8/1956 | Mahan | 44/69 |
| 2,830,019 | 4/1958 | Fields et al. | 252/33.6 |
| 2,908,711 | 10/1959 | Halter et al. | 252/392 |
| 2,954,342 | 6/1956 | Hotten | 252/32 |
| 2,977,309 | 3/1961 | Godfrey et al. | 252/392 |
| 3,173,770 | 3/1965 | Thompson et al. | 44/63 |
| 3,199,965 | 8/1965 | Andress, Jr. et al. | 252/392 |
| 3,202,491 | 8/1965 | Maxwell et al. | 44/71 |
| 3,224,957 | 12/1965 | Kent | 44/71 |
| 3,409,421 | 11/1968 | Belo et al. | 44/72 |
| 3,522,022 | 2/1969 | Hofheim et al. | 44/66 |
| 3,838,991 | 10/1974 | Garth | 44/66 |
| 3,996,024 | 12/1976 | Coon | 44/71 |
| 4,059,535 | 11/1977 | DeVault et al. | 252/33 |
| 4,162,223 | 7/1979 | Gragson et al. | 252/33.2 |

*Primary Examiner*—Y. Harris-Smith

*Attorney, Agent, or Firm*—A. W. Umphlett

[57] ABSTRACT

Certain branched chain amines and carboxylic derivatives thereof are useful additives for lubricants and fuels.

8 Claims, No Drawings

GASOLINE COMPOSITIONS CONTAINING BRANCHED CHAIN AMINES OR DERIVATIVES THEREOF

Background of the Invention

Carburetor detergents are conventionally included in gasoline compositions along with other additives, in order to enhance engine performance. They inhibit the formation of deposits in carburetors so that the mixing of fuel and air may take place more efficiently.

The Invention

The invention deals with the use of branched chain amines and derivatives thereof as additives for fuels and lubricants. The additives are rust inhibitors, corrosion inhibitors, carburetor detergents, and dispersants.

Object of the Invention

One object of the invention is the provision of a method of inhibiting rust deposits in fuel storage vessels.

Another object of the invention is a method of preventing unwanted deposits in carburetors.

Still another object is the production of useful dispersant additives for lubricants.

Description of the Invention

It has been discovered that a certain class of compounds are useful carburetor detergents. These compounds are also efficient rust-and-corrosion-inhibitors and dispersant additives for lubricants.

Amines

Amines which are useful in the invention are branched chain amines containing about 7 to 30 carbon atoms. They may be monoamines or multiamines having two or more amine groups.

One preferred method of making the subject amines is via the reaction of branched alkenes with unsaturated nitriles. For instance, 5,7,7-trimethyloctyl-amine may be produced by reacting diisobutylene with acrylonitrile and hydrogenating the product.

The subject amines conform to the general formula $$X—Q—NH_2$$

wherein X is —H, or —$NH_2$; and Q is an alkylene radical containing 7 to 30 carbon atoms, such that at least two carbon atoms link the X and $NH_2$ groups. Preferred amines are those wherein X is —H and from 1 to 4 of the substituents on the main chain of Q are —$CH_3$, or —$CH(CH_3)_2$ groups. Monoamines having 2 to 4 —$CH_3$ groups are preferred. Of these, 5,7,7-trimethyloctylamine and isoheptylamine are most preferred.

Derivatives of Amines

Instead of the branched amines themselves, reaction products of these amines with substituted or unsubstituted acids can be employed. The acid useful for reaction with the subject amines contain between 1 and 12 carbon atoms. The substituent groups, when present, can be one or more hydroxyl, amino, or carboxyl groups. The substituents may be situated along the main chain of the acid or they may be on side chains.

Useful acids may be monocarboxylic, e.g., formic, acetic, or propionic; dicarboxylic, e.g., oxalic, or succinic; or polycarboxylic, e.g., tetracarboxybutane. Polycarboxylic acids containing 2 to 24 carbon atoms are preferred.

The substituted acids can have one or more hydroxyl substituents, e.g., tartaric acid; one or more amino substituents, e.g., ethylene diaminetetraacetic acid; one or more carboxyl substituents, e.g., acetoacetic acid; or combinations thereof, e.g., citric acid.

Depending upon reaction conditions, the branched amines of this invention react with various of the functional groups in the subject acids. Preferably, the amines react with the carboxyl groups to form monoamides or polyamides. These amides can contain unreacted amino, carboxyl, and/or hydroxyl groups. Where appropriate, hydrocarbyl ester or anhydride groups can be substituted for any of the carboxyl groups in the acid compounds mentioned above.

Mixtures of one or more amines and one or more amine derivatives can be employed in additive combinations.

Additive Concentrations

The additives of the invention whether used as amines or amine derivatives are useful in varying amounts depending upon the formulations to which they are added.

As rust inhibitors and detergents for gasolines, lubricants, or other fuel compositions, they are useful in concentrations of about 10 to 10,000 ppm. As rust inhibitors for lubricants, they are preferably used at concentrations of about 0.1 to 10% by weight.

EXAMPLE I

A FALCON ENGINE TEST

A standard engine test for carburetor detergency was run on a fuel containing 5,7,7-trimethyloctylamine. This test showed an 83 percent reduction in carburetor deposits relative to a control with no additive. This 5,7,7-trimethyloctylamine shows excellent carburetor detergency, comparable to that shown by Phil-Ad CD (a commercially available carburetor detergent produced by Phillips Petroleum Co., Bartlesville, OK). The additive concentrations used and the resultant reductions in carburetor deposits are shown in the following table:

TABLE 1

| Additive | Amount (lb per 1000 bbl) | Reduction in Carburetor Deposits |
|---|---|---|
| 5,7,7-trimethyloctylamine | 10 | 83% |
| PHIL-Ad CD | 10 (active component) | 89% |

The Falcon Engine Test was conducted as follows:

The additive was added to unleaded Kansas City premium base gasoline (Phillips Petroleum Co.) in the amount of 10 lbs. of additive per 1000 barrels of gasoline. The test involves the use of the test gasoline in a 170 cubic inch displacement 6 cylinder Falcon automobile engine with a removable carburetor throat insert. The engine operated 23 hours at 1800 rpm and 11.4 brake horsepower. The difference in insert weight before and after the tests corresponds to the weight of deposits. Results are compared with tests using the same base gasoline without additives to determine the percent reduction of deposits.

EXAMPLE II

Three different polyamides were prepared by reacting stoichiometric amounts of 5,7,7-trimethyloctylamine with ethylenediamine tetraacetic acid, d-tartaric acid, and oxalic acid. The products of these reactions were tested for carburetor detergency in unleaded gasoline at a concentration of 10 lbs. per 1,000 barrels. The results of a Falcon Engine test are given below:

TABLE 2

| Amine | Acid | Reduction in Carburetor Deposits |
|---|---|---|
| TOA* | EDTA** | 80% |
| TOA* | d-tartaric | 57% |
| TOA* | oxalic | 64% |

*TOA = trimethyloctylamine

**EDTA = ethylenediaminetetraacetic acid

EXAMPLE III (Comparative)

Acetic acid and tallow amine (a $C_{16-18}$ straight chain amine) were reacted. The reaction product was insoluble in Falcon test fuel and, accordingly, was not a suitable additive.

EXAMPLE IV

Formic acid was reacted with each of 5,7,7-trimethyloctylamine and isoheptylamine. These reaction products and isoheptylamine were employed in Falcon engine tests at concentrations of 10 lbs. per 1,000 barrels. The results are given in the following table.

TABLE 3

| Amine | Acid | Reduction in Carburetor Deposits |
|---|---|---|
| *TOA | Formic | 46% |
| Isoheptylamine | Formic | (41% increase) |
| Isoheptylamine | none | (43% increase)[1] |
| Isoheptylamine | EDTA** | —[2] |

*TOA = trimethyloctylamine

**EDTA = ethylenediamine tetraacetic acid

[1]While isoheptylamine is not effective as a detergent, other data show it is effective as a rust inhibitor in lubricants.

[2]Not soluble in hexane, so no further tests conducted as gasoline additives.

Reasonable variations such as may occur to a skilled artisan are within the scope of this invention.

I claim:

1. A fuel composition containing a rust-inhibiting amount of at least one additive selected from:

(a) 5,7,7-trimethyloctylamine, (b) a reaction product of 5,7,7-trimethyloctylamine and a $C_{1-12}$ monocarboxylic acid or ester and (c) a reaction product of 5,7,7-trimethyloctylamine and a $C_{2-24}$ polycarboxylic acid, hydrocarbyl ester, or anhydride.

2. A fuel composition of claim 1 wherein the additive is (b) or (c) and the carboxylic acid bears at least one substituent selected from hydroxyl, amine, and carboxyl groups.

3. A fuel composition of claims 1 or 2 wherein the acid is selected from tartaric acid, citric acid, and ethylenediaminetetraacetic acid.

4. A fuel composition containing the reaction product of 5,7,7-trimethyloctylamine and tartaric acid.

5. A fuel composition containing the reaction product of 5,7,7-trimethyloctylamine and citric acid.

6. A fuel composition containing the reaction product of 5,7,7-trimethyloctylamine and ethylene diaminetetraacetic acid.

7. A method for reducing engine deposits in an internal combustion engine comprising the addition of at least one additive of claim 10 to the hydrocarbon fuel for the engine.

8. The method of claim 7 wherein the additive is the reaction product of 5,7,7-trimethyloctylamine with at least one acid selected from the group consisting of tartaric acid, citric acid, and ethylene diamine tetraacetic acid.

* * * * *

UNITED STATES PATENT AND TRADEMARK OFFICE

CERTIFICATE OF CORRECTION

PATENT NO. : 4,478,604

DATED : October 23, 1984

INVENTOR(S) : Alexander D. Schuettenberg

It is certified that error appears in the above-identified patent and that said Letters Patent is hereby corrected as shown below:

Claim 7, line 4, "claim 10" should be --claim 1--.

Signed and Sealed this

*Ninth* Day of *July 1985*

[SEAL]

*Attest:*

DONALD J. QUIGG

*Attesting Officer* *Acting Commissioner of Patents and Trademarks*